US009878877B2

(12) United States Patent
Pursiainen et al.

(10) Patent No.: US 9,878,877 B2
(45) Date of Patent: Jan. 30, 2018

(54) ELEVATOR AND MEANS FOR FORMING A SAFETY SPACE

(71) Applicant: KONE CORPORATION, Helsinki (FI)

(72) Inventors: Jari Pursiainen, Lempäälä (FI); Samuli Mäntynen, Espoo (FI); Matti Räsänen, Hyvinkää (FI); Jaakko Kahila, Karkkila (FI); Keijo Vajavaara, Hyvinkää (FI); Mika Alvesalo, Espoo (FI); Markku Haapaniemi, Helsinki (FI); Kristian Viinikkala, Espoo (FI)

(73) Assignee: KONE CORPORATION, Helsinki (FI)

( * ) Notice: Subject to any disclaimer, the term of this patent is extended or adjusted under 35 U.S.C. 154(b) by 61 days.

(21) Appl. No.: 14/752,559

(22) Filed: Jun. 26, 2015

(65) Prior Publication Data

US 2015/0321882 A1 Nov. 12, 2015

Related U.S. Application Data

(63) Continuation of application No. PCT/FI2013/051205, filed on Dec. 27, 2013.

(30) Foreign Application Priority Data

Jan. 7, 2013 (FI) ..... 20135021

(51) Int. Cl.
*B66B 5/00* (2006.01)
*B66B 13/02* (2006.01)

(52) U.S. Cl.
CPC ..... *B66B 5/005* (2013.01); *B66B 5/0056* (2013.01); *B66B 5/0068* (2013.01); *B66B 5/0075* (2013.01); *B66B 13/02* (2013.01)

(58) Field of Classification Search
CPC ..... B66B 5/005; B66B 5/0056; B66B 5/0068; B66B 5/0075; B66B 13/02
(Continued)

(56) References Cited

U.S. PATENT DOCUMENTS 5,727,657 A * 3/1998 Foelix ..... B66B 5/005 187/356
5,773,771 A * 6/1998 Chatham ..... B66B 17/34 187/276
(Continued)

FOREIGN PATENT DOCUMENTS

CN 1434784 A 8/2003
CN 101112954 A 1/2008
(Continued)

*Primary Examiner* — Michael A Riegelman
(74) *Attorney, Agent, or Firm* — Birch, Stewart, Kolasch & Birch, LLP

(57) ABSTRACT

An elevator includes at least an elevator car arranged to move reciprocally in an elevator hoistway and fitted on guide rails, a plurality of landing doors having landing door locks openable e.g. with a service key, and a safety arrangement arranged to form a safe space, preferably a working space, in the elevator hoistway below the elevator car, access to which safe space is enabled via at least one landing door in the proximity of the base of the elevator hoistway, and/or a safe space, preferably a working space, above the elevator car, to which access is enabled via at least one landing door leading to the roof of the elevator car, and in which elevator the aforementioned safe space has a minimum height. The formation of each safe space is arranged to be implemented as a consequence of the opening occurring, e.g. with a service key, from a floor level of a landing door enabling access into the elevator hoistway.

15 Claims, 5 Drawing Sheets

Figure 1:
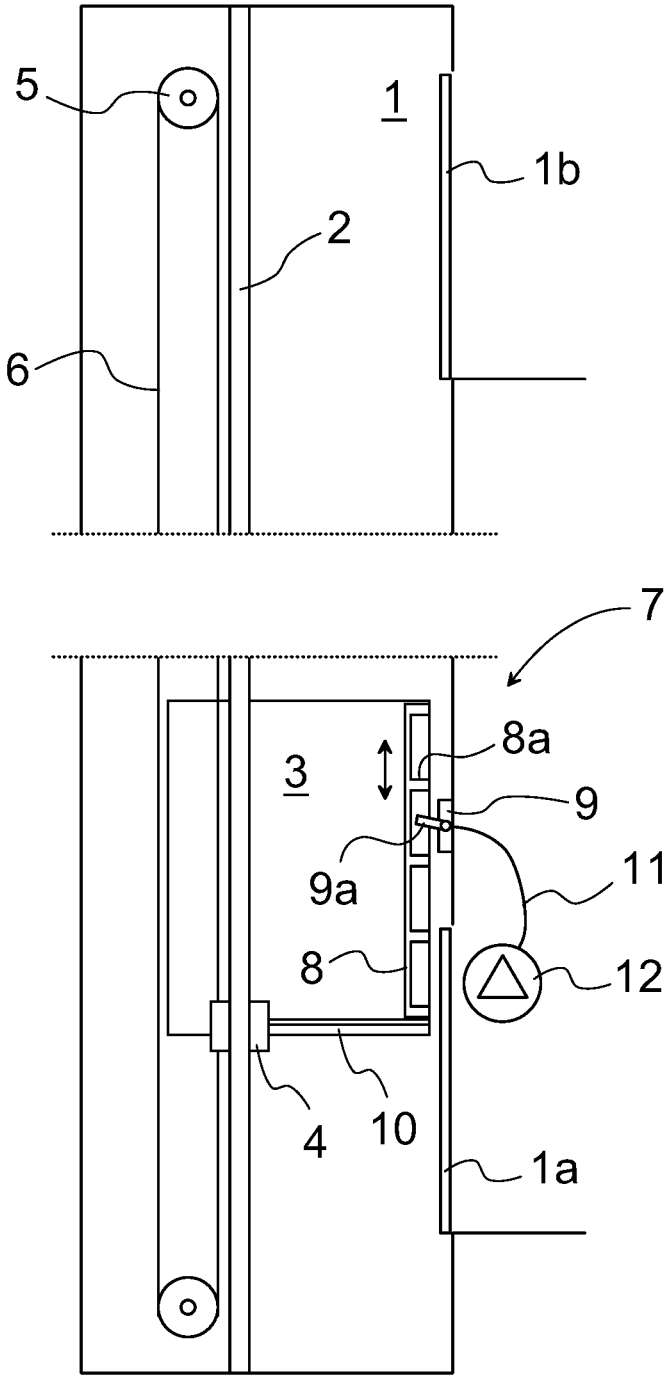

(58) Field of Classification Search
USPC ..... 187/360
See application file for complete search history.

(56) References Cited

U.S. PATENT DOCUMENTS

| | | | | |
|---|---|---|---|---|
| 7,258,202 | B1 * | 8/2007 | Rossignol | B66B 5/005 187/351 |
| 2004/0222046 | A1 * | 11/2004 | Gut | B66B 5/005 187/343 |
| 2008/0047783 | A1 * | 2/2008 | Vogl | B66B 5/0087 187/314 |
| 2008/0099284 | A1 | 5/2008 | Kocher et al. | |
| 2009/0255762 | A1 * | 10/2009 | Ketonen | B66B 13/22 187/247 |
| 2010/0155184 | A1 * | 6/2010 | Sirigu | B66B 5/0068 187/302 |
| 2010/0163346 | A1 * | 7/2010 | Coquerelle | B66B 5/0068 187/247 |
| 2011/0083926 | A1 | 4/2011 | Räsänes et al. | |
| 2012/0305334 | A1 * | 12/2012 | Kocher | B66B 5/005 187/247 |
| 2014/0076670 | A1 * | 3/2014 | Henseler | B66B 1/466 187/331 |
| 2014/0116811 | A1 * | 5/2014 | Aulanko | B66B 5/0068 187/359 |
| 2016/0325964 | A1 * | 11/2016 | Haapaniemi | B66B 5/005 |
| 2016/0325965 | A1 * | 11/2016 | Haapaniemi | B66B 5/005 |

FOREIGN PATENT DOCUMENTS

| | | | | |
|---|---|---|---|---|
| CN | 102076593 | A | 5/2011 | |
| EP | 1 110 900 | A1 | 6/2001 | |
| EP | 1110900 | A1 | 6/2001 | |
| EP | 1 118 574 | A2 | 7/2001 | |
| EP | 1422182 | A1 | 5/2004 | |
| EP | 1466853 | A1 | 10/2004 | |
| EP | 1 882 666 | A1 | 1/2008 | |
| EP | 2727871 | A1 | 5/2014 | |
| GB | 1498039 | A * | 1/1978 | B66B 13/165 |
| NO | 323028 | B1 | 12/2006 | |
| WO | WO 87/05282 | A1 | 9/1987 | |
| WO | WO 02/096791 | A1 | 12/2002 | |
| WO | WO 2007/029049 | A1 | 3/2007 | |

* cited by examiner

ELEVATOR AND MEANS FOR FORMING A SAFETY SPACE

CROSS REFERENCE TO RELATED APPLICATIONS

This application is a Continuation of PCT International Application No. PCT/FI2013/051205 filed on Dec. 27, 2013, which claims priority under 35 U.S.C. 119(a) to Patent Application No. 20135021, filed in Finland on Jan. 7, 2013, all of which are hereby expressly incorporated by reference into the present application.

The object of the invention is an elevator that comprises a plurality of landing doors. The invention also relates to the formation of a safety space or safety spaces.

Usually in elevators the elevator car is arranged to travel up and down in an elevator hoistway, which is normally an enclosed space, to which other people than servicing employees do not have access. In a servicing situation a servicing employee must possibly gain access to parts of the elevator that are situated in the hoistway, which parts can be situated at the base of the hoistway, in the top part of the hoistway or somewhere between them. In a servicing situation the elevator car must be driven to a suitable location, depending on which point in the hoistway the servicing procedures must be carried out. For example, if servicing procedures are needed at the base of the hoistway, the car must be driven sufficiently upwards in such a way that there is access to the base of the hoistway from the bottommost floor level. If servicing is needed in the top part of the hoistway, the car can be driven to a suitable height in such a way that from the topmost floor level it is possible to perform the servicing procedures from the roof of the car. Correspondingly, if e.g. the guide rails of the elevator must be serviced at some other point in the hoistway, the car can be driven to a suitable height and access to the roof of it is possible from some suitable floor level.

When servicing procedures are being performed in the elevator hoistway, the safety of servicing employees must be ensured. Particularly if an elevator car is near a servicing employee during servicing, unexpected movement of the car can cause a dangerous situation. This type of situation can occur e.g. if/when parts on the base of the elevator car or on the bottom part of the car are serviced in such a way that the servicing employee is on the base of the elevator hoistway.

The elevator car may not, therefore, start moving during servicing or if for some reason it starts to move it must be brought to stop quickly. The size of the safe working space, i.e. the distance of the car from the bottom end or from the top end of the elevator hoistway, is also defined in elevator regulations.

Solutions exist that can be activated during servicing work, and which prevent movement of the elevator car to too close to the bottom end or the top end of the hoistway, thus making the elevator hoistway a safer working space. One such solution is to arrange the safety gear to grip the guide rails of the elevator if the elevator car moves past a certain predefined safety height. A problem in this type of solution is that the elevator car can already be on the wrong side of the predefined safety height when the servicing employee activates the safety system. In such a case the servicing employee can be exposed to danger even though the safety system were to be activated. In this type of solution it can also be unclear to the servicing employee whether it is safe to go into the hoistway or not. Particularly in solutions in which the safety system is switched on by remote control, it may be unclear to a servicing employee whether the safety system is reliably activated.

The aforementioned problems can be avoided by setting a predefined safety height so close to the end of the hoistway that a servicing employee going into the elevator hoistway will see whether the elevator car is on the correct side of the safety height. A problem with this solution is that it is based on visual observation. It can be difficult to see into the hoistway, especially if the lighting is poor. Sometimes performing an inspection can even be forgotten. This solution, also, is not completely free of risk. Setting the safety limit too close to the end of the elevator hoistway can also cause other problems. When the safety gear activates, the elevator car still moves some distance afterwards. This distance cannot generally be predicted accurately, owing to which the safety space can prove to be too shallow. Known solutions for arranging a temporary safety space in an elevator hoistway are presented e.g. in publications US2008099284A1, EP1118574A2, EP1110900A1 and U.S. Pat. No. 5,727,657A.

Another problem is that the monitoring solutions for the bottom safety space and top safety space in use nowadays are not able to detect which of the doors of a floor level has been opened for servicing purposes. In this case it cannot be known unambiguously whether the servicing employee performing the work is going to the base of the elevator hoistway or onto the roof of the elevator car. Owing to this, current monitoring solutions according to prior-art are complex and unreliable.

The aim of the present invention is to eliminate the aforementioned drawbacks and to achieve an inexpensive and easy-to-implement elevator having a safety arrangement that enables the reliably safe performance of servicing jobs in the elevator hoistway regardless of whether the object of the servicing work is in the bottom end or in the top end of the elevator hoistway, or somewhere between these ends. Preferred embodiments of the invention are disclosed in the claims.

Some inventive embodiments are also presented in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can in at least suitable situations be deemed to be inventive in their own right.

One advantage, among others, of the solution according to the invention is that by means of it various servicing jobs can be performed in the elevator hoistway safely. The invention can also be applied to creating a compulsory safety space as well as to creating a sufficient working space.

An advantage in some aspects of the invention is a simple solution, with which it is possible to isolate, on the basis of opening of each, or at least some, floor level door, whether the servicing point is above or below the elevator car and thus to obtain assurance of the safety of servicing work.

One preferred aspect of the invention discloses means with which the formation of a work space/safety space or work spaces/safety spaces in an elevator at the base of the elevator hoistway and/or in the top part of the elevator hoistway is achieved. Preferably these types of means comprise a detector of the opening of a floor level lock, or corresponding, and even more preferably the detector means is connected to bring about the operation of the means forming a space of the safety space. A preferred method for detecting opening of a lock and for bring about operation of a safety arrangement is to use the opening movement of the lock also as the initiating force, or even as the operating force, of the safety arrangement. For example, the movement to be used for opening a lock can be used with a mechanical transmission means for bringing about operation of the safety means or at least for tripping or initiating operation of the safety means. This sort of aspect becomes evident e.g. as a means for forming a safety space or safety spaces in an elevator at the base of the elevator hoistway or in the top part of the elevator hoistway, or in both, in which case the means comprise a detector, or corresponding, of the opening of a floor level lock and in which case operating force is transmitted, e.g. with a mechanical transmission means, from the opening movement of the lock for bringing about operation of the safety means or at least for tripping or initiating operation of the safety means. Preferably the mechanical transmission means also simultaneously functions as a detector and is connected from a lock that is on a floor level to a safety member of the safety means.

The invention can be implemented for example per se as an elevator comprising a plurality of landing doors, which can be opened e.g. in connection with servicing procedures with a service key suited to a landing door lock and in which elevator is a safety arrangement, which comprises means for forming a safe space, preferably a working space, in the elevator hoistway below the elevator car, access to which safe space is enabled via at least one landing door that is in the proximity of the base of the elevator hoistway, and/or a safe space, preferably a working space, above the elevator car, access to which safe space is enabled via at least one landing door leading to the roof of the elevator car. This type of safe space has a minimum height that is preferably such that it also enables working. The formation of a safe space is arranged to be implemented as a consequence of the opening, e.g. to be performed with a service key, occurring from a floor level of a landing door enabling access into the elevator hoistway. Preferably the opening of an individual landing door is detected with a mechanical detector means and the detection is transmitted mechanically to a safety member belonging to safety means that compels the formation of a safety space.

The safe space that is the aim of the invention can be brought about by stopping and locking the elevator car into its position if a landing door is opened. Alternatively, the safe space that is the aim of the invention can be brought about by preventing movement of the elevator car into the safety space if a landing door is opened.

Preferably the opening of only any one, generally the bottommost landing door, or of some landing doors results in the formation of a safe space at the base of the elevator hoistway.

Preferably the opening of only one landing door, from which there is access to the roof of the elevator car, or of only those landing doors from which there is access to the roof of the elevator car, results in the formation of a safe space in the top part of the elevator hoistway.

A preferred embodiment of the invention is one wherein a safe space can be formed both at the base of the elevator hoistway and also in the top part of the elevator hoistway and wherein the formation of a safe space at the base of the elevator hoistway or in the top part of the elevator hoistway is brought about to operate selectively depending on which of the landing doors of the elevator is opened.

The formation of a safe space can, alongside or as an alternative to mechanical detection, be based on electrical or other detection of the opening of a floor level door or of the lock of a floor level door. Correspondingly bringing about operation of the safety arrangement for achieving a safe space can occur in some other way also than using just mechanical power transmission.

In forming a safe space, in locking the elevator car into its position or in stopping or preventing movement of it, a separate actuator, or separate actuators, to that/those moving the elevator is/are used. Preferably safety gears gripping a guide rail, either unidirectional or bidirectional safety gears, controllable buffers or buffer stops, arrester levers or other brake means, e.g. guide rail brakes, can be used as these types of actuators.

Figure 2:
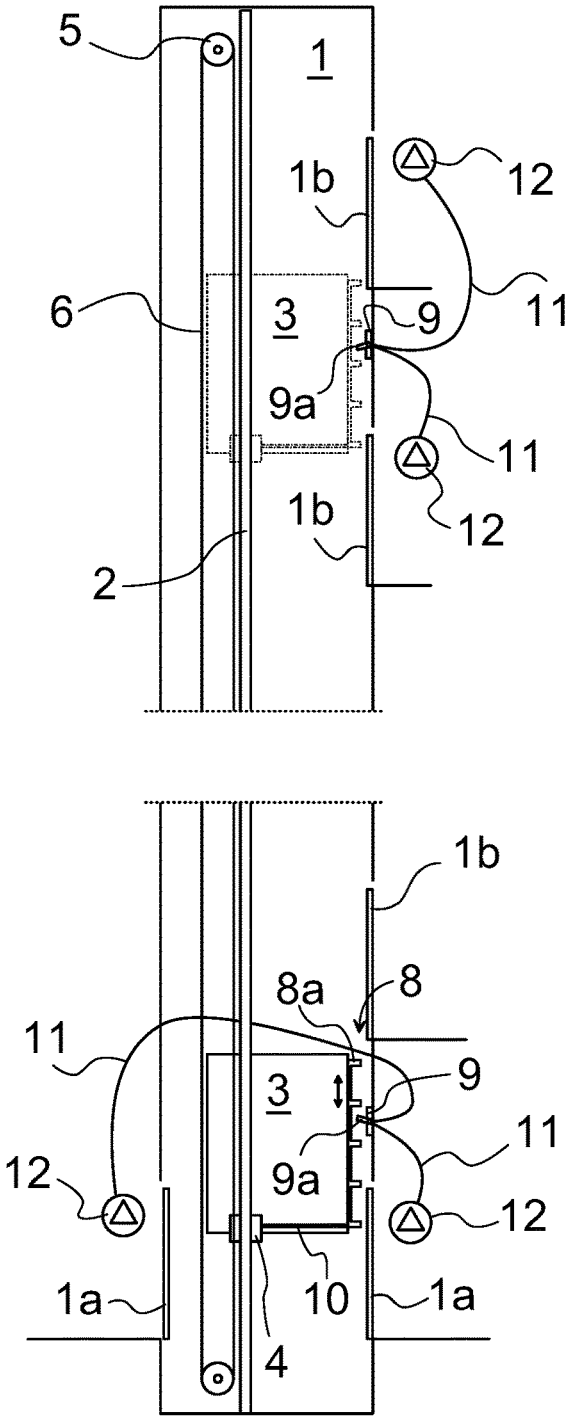
Figure 3:
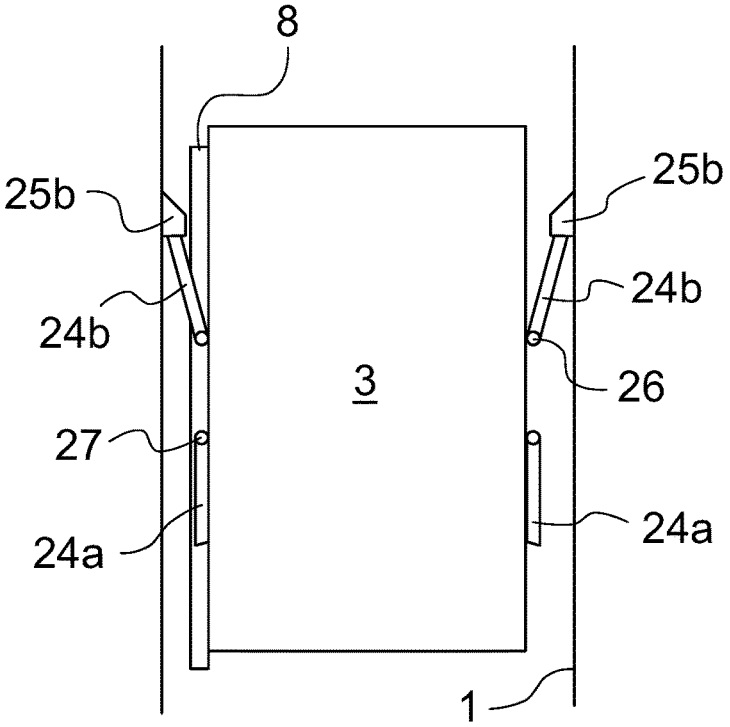
Figure 4:
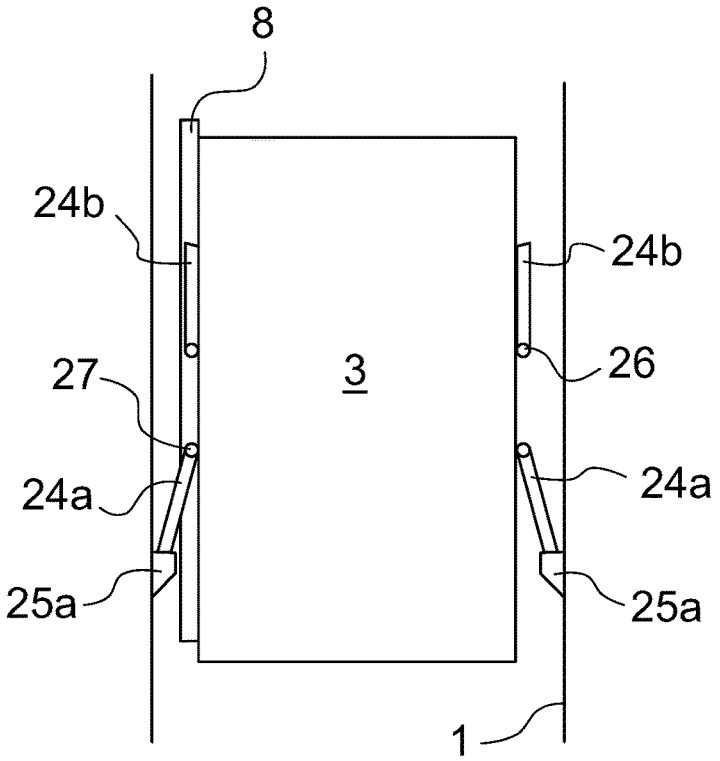
Figure 5:
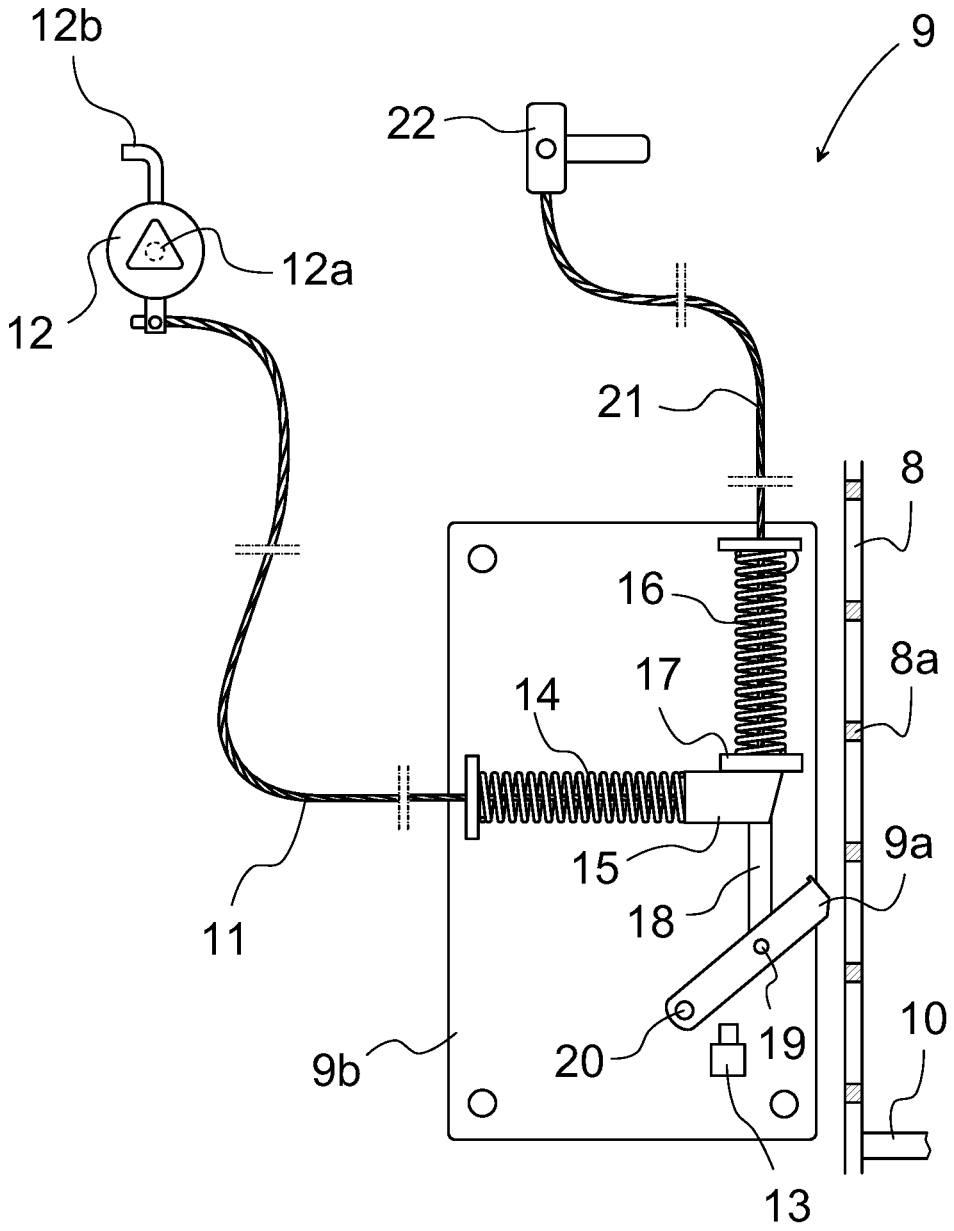
Figure 6:
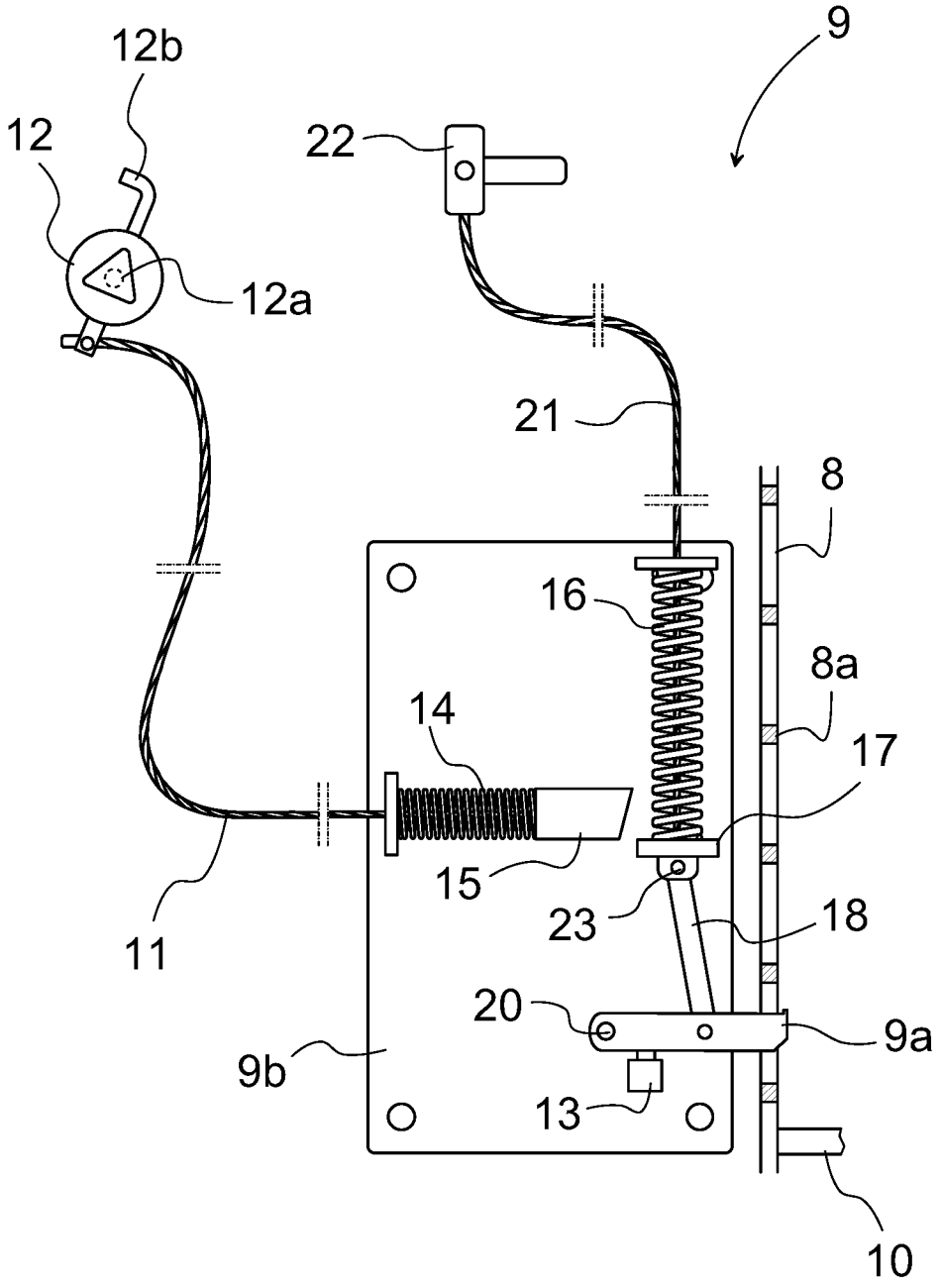

In the following, the invention will be described in more detail by the aid of some examples of its embodiment with reference to the simplified and diagrammatic drawings attached, wherein FIG. 1 presents a simplified and diagrammatic side view of one embodiment of a safety arrangement of an elevator according to the invention, FIG. 2 presents a simplified and diagrammatic side view of one second embodiment of a safety arrangement of an elevator according to the invention, FIG. 3 presents a simplified side view of one preferred safety stopping arrangement, in the top end of the elevator hoistway, of an elevator car relating to the solution according to the invention, FIG. 4 presents a simplified side view of one preferred safety stopping arrangement, in the bottom end of the elevator hoistway, of an elevator car relating to the solution according to the invention, FIG. 5 presents a simplified side view of one safety device belonging to the safety arrangement of an elevator according to the invention, when switched off, and FIG. 6 presents a simplified side view of a safety device according to FIG. 5, when switched into the safe position.

In the solution according to the invention it is ensured inter alia whether a servicing employee is going to the base of the elevator hoistway to below the elevator car, or onto the roof of the elevator car, or otherwise into the elevator hoistway above the elevator car. In this case according to the invention the arrangement comprises means, by the aid of which the bottommost door leading into the elevator hoistway is isolated, i.e. in practice in most cases the door of the bottommost floor level, or in certain cases two or more bottommost floor level doors, are isolated from the rest of the door system in such a way that if the lock of a door of the bottommost floor level, said door being on any side of the elevator car whatsoever, is opened for special use, such as with a key intended for servicing use, then the safety devices of the bottom part of the elevator hoistway that supervise and prevent downward movement of the elevator car trip either mechanically, e.g. via a flexible thin steel rope, or electrically, and the elevator goes into a safe drive mode. Now at the same time the arrangement knows certainly that a servicing employee is going to below the elevator car, e.g. to the base of the elevator hoistway.

If, on the other hand, any of the other floor level doors is opened with the aforementioned key intended for special use, then it is known certainly that a servicing employee is going into a hoistway space above the elevator car, e.g. onto the roof of the elevator car. In this case the elevator car will not move anywhere before the safety devices of the top part of the elevator hoistway that supervise and prevent upward movement of the elevator car trip either mechanically, e.g. via a flexible thin steel rope, or electrically, and the elevator goes into a safe drive mode.

FIG. 1 presents an elevator which comprises at least an elevator car 3 arranged to move reciprocally in an elevator hoistway 1 and fitted on guide rails 2, onto the bottom part of which elevator car is fitted a safety gear 4 stopping movement of the elevator car. The elevator also comprises an overspeed governor 5, the rope 6 of which is connected to a safety gear 4 for tripping the safety gear.

In the elevator are also safety means 7, which comprise a counterpart 8 fitted onto one side of the elevator car 3 and moving along with the elevator car and also, against the counterpart 8, a safety device 9 that is fitted in connection with a wall of the elevator hoistway and provided with a safety member 9*a*. The safety device 9 can also be fixed in some other rigid location, e.g. on a guide rail 2 of the elevator car 3. The counterpart 8 is fitted to be movable in the vertical direction in relation to the elevator car 3. The counterpart 8 comprises a plurality of detent members 8*a*, which in the embodiment of FIG. 1 are teeth protruding from the side of the elevator car 3 towards the wall of the elevator hoistway 1. The detent members 8*a* can just as well be spurs between an aperture row, as is presented in FIGS. 5 and 6. The safety member 9*a* is e.g. a metal pin or corresponding, which is hinged e.g. to a bracket on the wall of the hoistway 1 and is arranged to be turnable in such a way that when the elevator car 3 is at the height of the safety member 9*a* in the hoistway 1, the safety member 9*a* extends between the detent members 8*a* of the counterpart 8.

The counterpart 8 is connected to the safety gear 4 of the elevator e.g. via a connector rod 10. When the safety member 9*a* is turned to be between detent members 8*a*, it is in its so-called safe position. Between which detent members 8*a* the safety member 9*a* fits depends on the location of the elevator car 3 in the elevator hoistway 1. The safety member 9*a* can also fit below the bottommost detent member 8*a*, if the height position of the elevator car 3 is such. In this case the safety member 9*a* is therefore not between any two detent members 8*a* and the bottommost detent member 8*a* functions as the counterpart of it.

If the elevator car 3 moves downwards when the safety member 9*a* is in its safe position, the detent member 8*a* of the counterpart 8 hits the safety member 9*a*, in which case the movement of the counterpart 8 in relation to the hoistway 1 stops, and the counterpart 8, stopped by the safety member 9*a*, moves relatively upwards with respect to the elevator car 3, in which case the connector rod 10 pulls the wedges, or corresponding locking means, of the safety gear 4 against the guide rails 2, and movement of the elevator car 3 stops.

When e.g. in a servicing situation it is desired to ensure that the elevator car 3 does not move downwards, the safety member 9*a* is turned into its safe position i.e. in such a way that it is between two detent members 8*a* or immediately below the detent members 8*a*. In the embodiment of FIG. 1 the safety member 9*a* is connected, e.g. via a flexible transmission means 11, such as a steel rope, to a lock 12 fitted into a landing door 1*a* that is on the bottommost floor level, by the aid of which lock the floor level door 1*a* is opened, e.g. with a special key, when the elevator is not in normal drive. The lock 12 presented in FIG. 1 can be opened and closed with a special key, e.g. with a triangular key, which keys are generally used in elevators precisely for opening doors in connection with servicing jobs. When a servicing employee opens a floor level door 1*a* via a lock 12 to gain access into the elevator hoistway, the transmission means 11 at the same time mechanically turns the safety member 9*a* into its safe position. When the door 1*a* of the bottommost floor level is isolated from the rest of the door system, at the same time it is known certainly that a servicing employee is going to the base of the elevator hoistway 1 to below the elevator car 3, where a safe space, e.g. a working space, is thus formed.

When the lock 12 is locked after the servicing work, the safety member 9*a* must be separately switched out of its safe position, e.g. from an electrical switch or corresponding disposed in the machine room of the elevator, or e.g. by pulling the safety member out of its safe position by the aid of a second transmission means, such as a steel rope, connected to the safety member 9*a*. This solution is explained in more detail later in connection with FIGS. 5 and 6.

FIG. 2 presents a simplified and diagrammatic side view of one second embodiment of the safety arrangement of an elevator according to the invention. In this solution the aforementioned isolation of the doors 1*a* of the bottommost floor level or bottommost floor levels from the rest of the door system is presented illustratively.

A difference to the solution presented by FIG. 1 is now that also other floor levels than the bottommost floor level or floor levels have a lock 12 of the floor level door to be opened with a triangular key for the purpose of servicing work. In addition, at least on the topmost floor is a safety device 9 stopping undesired movement of the elevator car 3. In this solution safety devices 9 are not necessarily needed elsewhere than on the bottommost and on the topmost floor level, but in some cases safety devices 9 can also be on many floors.

In the solution according to FIG. 2 the safety device 9 of the bottommost floor level enabling a safe space intended for the bottom clearance of the elevator hoistway 1 can be tripped via a transmission means 11 either from one or from more than one bottommost floor level, if e.g. a through-type elevator car is involved, said through-type car having doors on more than one side, in which case each side also has its own bottommost floor level and a floor level door 1*a* thereof. In this case one or more doors 1*a* of the bottommost floor level has a lock 12 e.g. openable with a triangular key, which lock is connected by the aid of its own transmission means 11 to one and the same safety device 9 of the bottommost floor. FIG. 2 presents an example solution, in which is a through-type elevator car 3 and two bottommost floor levels, one on a first side of the elevator car and the other on a second side of the elevator car. When using a lock 12, openable with a special key, of either whatsoever bottommost floor level for opening the bottommost landing door 1*a*, one or the other transmission means 11 mechanically turns the same safety member 9*a* of the bottommost floor level into its safe position. When the doors of the bottommost floor levels are mechanically isolated in this way from the rest of the door system, at the same time it is known certainly that a servicing employee is going into the elevator hoistway 1 to below the elevator car 3, e.g. to the base of the elevator hoistway 1.

If a lock 12 of a floor level other than the bottommost floor level or bottommost floor levels is opened, the opening of the lock 12 affects either the tripping of the safety device 9 of specifically the other floor level in question or, depending on the solution, the tripping of the safety device 9 of always only the topmost floor level, because from the viewpoint of the safety of the top clearance the safety device 9 on the topmost floor level, being the last in the direction of travel of the elevator car, is in a more important position than the others. The safety device 9 on the topmost floor level operates in the opposite direction than the corresponding safety device 9 on the bottommost floor level, because it may not allow the elevator car 3 to go too far upwards.

Between which detent members 8*a* the safety member 9*a* of the safety device 9 fits depends on the location of the elevator car 3 in the top part of elevator hoistway 1. The safety member 9*a* can also fit above the topmost detent member 8*a*, if the height position of the elevator car 3 is such. In this case the safety member 9*a* is therefore not between any two detent members 8*a* and the topmost detent member 8*a* functions as the counterpart of it.

When the elevator car 3 is in the top part of the elevator hoistway 1 and some door 1*b* of an upper floor is opened via the lock 12, the safety member 9*a* is outside in its safe position. If the elevator car 3 in this case moves upwards, the detent member 8*a* of the counterpart 8 hits the safety member 9*a*, in which case the counterpart 8, stopped by the safety member 9*a*, moves relatively downwards with respect to the elevator car 3 and the connector rod 10 pulls the wedges, or corresponding locking means, of the safety gear 4 against the guide rails 2, and movement of the elevator car 3 stops.

The connector rod 10 is fitted into the arrangement e.g. by the aid of lever means in such a way that it functions as an activation means of the safety gear 4 when the elevator car 3 moves in either direction whatsoever. When the doors 1*b* of the other floor levels are isolated from the door 1*a* of the bottommost floor level or of the bottommost floor levels, at the same time it is known certainly in connection with the opening of a lock 12 of an upper floor level that a servicing employee is going into the elevator hoistway 1 into a space above the elevator car 3, e.g. onto the roof of the elevator car 3, and that the elevator car 3 may not in this case move too far upwards. In this case a safe space, e.g. a working space, is formed in the elevator hoistway 1 above the elevator car 3.

As mentioned in the preceding the isolation of the door 1*a* of bottommost floor level or of bottommost floor levels from the rest of the door system and from the other floor level doors 1*b* can be done either mechanically or electrically either by switching on the safety device 9 preventing downward movement of the elevator car 3 or by switching on the safety device 9 preventing upward movement of the elevator car 3 depending on which floor level door 1*a*, 1*b* has been opened with a special key via a lock 12. This is important, inter alia, in the types of elevators in which the safety spaces in the hoistways are, owing to the structures, small or even inadequate.

In the aforementioned mechanical solution e.g. a thin flexible steel rope is used as a transmission means 11, which is joined from a lock 12 of a certain floor level door or of certain floor level doors directly either to a safety device 9 in the bottom part of the elevator hoistway or to a safety device 9 in the top part of the elevator hoistway. Correspondingly in the electrical solution electrical actuators are used, which are connected from a lock 12 of a certain floor level door or of certain floor level doors directly either to a safety device 9 in the bottom part of the elevator hoistway or to a safety device 9 in the top part of the elevator hoistway. In this case when opening with a special key the lock 12 of any floor level door whatsoever the safety device 9 of the correct end, bottom end or top end, of the elevator hoistway 1 always surely switches on and the aforementioned safe space is formed in exactly the correct end of the elevator hoistway 1.

FIGS. 3 and 4 present a simplified view of one preferred safety stopping arrangement, in the bottom end and top end of the elevator hoistway 1, of an elevator car 3 relating to the solution according to the invention. This solution replaces the safety stopping arrangement of the elevator car 3 implemented with a safety gear 4. Instead of a safety gear 4 the counterpart 8 is now connected, e.g. with a lever arrangement, to the safety stopping means 24*a* and 24*b* that are fixed in a hinged manner to the elevator car 3, such as e.g. to rod-shaped flexible buffers or to corresponding structures.

The lower safety stopping means 24*a*, which are e.g. one on both opposite sides of the elevator car 3, are hinged at their top end to the elevator car 3 by the aid of a joint 27 and arranged to turn at their bottom end away from the elevator car 3 when the counterpart 8 moves upwards in relation to the elevator car 3 stopped by the safety member 9*a* of a safety device 9 in the bottom end of the elevator hoistway 1. In this case when the elevator car 3 continues its movement downwards the bottom ends of the lower safety stopping means 24*a*, said ends being turned outwards, are arranged to hit the stopping detents 25*a* on the wall of the elevator hoistway 1, or in another fixed location, in the bottom part of the elevator hoistway, in which case the downward movement of the elevator car 3 stops and a safe space, e.g. suitable as a working space, remains below the elevator car 3.

Correspondingly the upper safety stopping means 24*b* that correspond structurally and functionally to the lower safety stopping means 24*a*, which upper safety stopping means are e.g. one on both opposite sides of the elevator car 3, are hinged at their bottom end to the elevator car 3 by the aid of a joint 26 and arranged to turn at their top end away from the elevator car 3 when the counterpart 8 moves downwards in relation to the elevator car 3 stopped by the safety member 9*a* of a safety device 9 in the top end of the elevator hoistway 1. In this case when the elevator car 3 continues its movement upwards the top ends of the upper safety stopping means 24*b*, said ends being turned outwards, are arranged to hit the stopping detents 25*b* on the wall of the elevator hoistway 1, or in another fixed location, in the top part of the elevator hoistway, in which case the upward movement of the elevator car 3 stops and a safe space, e.g. suitable as a working space, remains above the elevator car 3.

FIGS. 5 and 6 present in more detail and in simplified form one safety device 9 belonging to the safety arrangement according to the invention. In FIG. 5 the safety device is in the position of normal operation of the elevator, i.e. not tripped and switched on, and in FIG. 6 the safety device 9 is tripped and in the safe position after opening of a lock 12, i.e. switched on.

The safety device 9 has a mounting base 9*b* as a frame, by the aid of which the safety device 9 is fixed in the elevator hoistway to its rigid fixing location according to purpose, e.g. on the wall of the elevator hoistway 1 or on the guide rail 2 of the elevator car 3. The safety device 9 is fixed in such a way that when the elevator car 3 comes to the point of the safety device 9 the elongated counterpart 8 that is on the outer wall of the elevator car 3 is so close to the safety device 9 that the pin-type or corresponding safety member 9*a* of the safety device 9 can turn in front of the detent members 8*a* that are on the counterpart 8, stopping possible movement of the counterpart 8.

A tripping device of the safety device 9 is fixed to the frame 9*b* of the safety device 9, said tripping device comprising a locking detent 15 and a spring means 14 pressing against the locking detent. The second end of a flexible transmission means 11, such as a thin steel rope, is fixed to the locking detent 15 and correspondingly the first end of the transmission means 11 is fixed to a lever mechanism of the lock 12 of a landing door, which lever mechanism trips the safety member 9*a* of a safety device 9 into its safe position by pulling the transmission means 11.

The locking detent 15 can also be connected to electrical actuators, in which case opening of the lock 12 switches on the aforementioned electrical actuators, which by displacing the locking detent 15 trip the safety member 9*a* of a safety device 9 into its safe position, and correspondingly when returning the elevator to the normal state return the locking detent 15 to its initial position to keep the safety member 9*a* in its inner position.

The locking detent 15 locks the pin-type or lever-type safety member 9*a* of the safety device 9 in its inner position in such a way that the safety member 9*a* does not hit the counterpart 8 moving along with the elevator car 3 nor the detent members 8*a* of it. The safety member 9*a* is hinged at its first end to be turnable around the joint pin 20 into both its aforementioned inner position and its outer position, i.e. locking position, in which the safety member 9*a* hits some detent member 8*a* of the counterpart 8, stopping the movement of the counterpart 8 even though the elevator car 3 were to continue moving.

In addition, the safety member 9*a* is hinged from between its first and second end by the aid of a joint pin 19 to a spring-loaded transmitter means, comprising a stopper means 17, a transmission rod 18 hinged with a joint 23 at its first end to the stopper means 17, and a spring means 16 pressing the stopper means 17 towards the locking detent 15. The safety member 9*a* is hinged to the free end, i.e. to the second end, of the transmission rod 18 of the transmitter means. In addition, the second end of a flexible transmission means 21, such as a thin steel rope, is fixed to the transmitter means, e.g. to the stopper means 17 of it, the first end of which transmission means is fixed e.g. to a return device 22 in the machine room or control cubicle of the elevator, which return device can be mechanical, as in this example, or also electrically operable. With the return device 22 the safety member 9*a* is pulled back into its inner position against the compression load of a spring means 16.

The safety device presented in FIGS. 5 and 6 function e.g. in such a way that when opening a floor level door the triangular key of the lock 12 is turned around the axis 12*a* of the lock, in which case the lever mechanism of the lock simultaneously turns around the axis 12*a*. In this case the catch 12*b* of the lock releases the locking of the floor level door otherwise than what occurs in a normal situation via the door coupler and simultaneously the transmission means 11 pulls the locking detent 15 into the safe position out of the path of the stopper means 17 of the transmitter means, in which case under the effect of both the compression force of the spring means 16 and partly also of the gravity of the earth the safety member 9*a* turns into its outer position, i.e. into the locked position, as has been stated in the preceding. When the floor level door is again locked with the lock 12, the transmission means 11 loosens and the spring means 14 is able to press the locking detent 15 back into its locking position. Before this, however, the safety member 9*a* must be pulled into its inner position by the aid of the return device 22, in which case at the same time the stopper means 17 of the transmitter means rises to above the detent surface of the locking detent 15.

Supervision means 13, which are arranged to monitor the state of the safety member 9*a*, i.e. whether the safety member 9*a* is in its inner position or in its outer position, are also connected to the safety member 9*a*. The supervision means 13 can be composed e.g. of a microswitch, which is disposed in the proximity of the pin-like part of the safety member 9*a* in such a way that when the safety member 9*a* is in its outer position it simultaneously switches the microswitch on and when the safety member 9*a* is turned into its inner position it simultaneously switches the microswitch off. The supervision means 13 are connected to the control system of the elevator and when the safety member 9*a* is in its safe position, i.e. in its outer position, the control system is arranged to prevent normal drive of the elevator.

Monitoring of the hoistway space above the elevator car 3 can be performed electrically with supervision means belonging to the arrangement in such a way that when a type of floor level door from which there is access to the space above the elevator car 3 is opened via the lock 12 the supervision means trip the electronic supervision and disconnect the safety circuit of the elevator. The means for electrical supervision comprise e.g. two supervision circuits that are separate from each other, which are arranged to remember their state also after an electricity outage situation. For implementing electrical supervision, supervision switches are installed on the doors of a floor level, which switches are arranged to control the relays, or other corresponding apparatus, that are in the control panel of the elevator and are a part of the safety circuit of the elevator.

The supervision switches on the doors of floor levels can also be directly a part of the safety circuit of the elevator, in which case one supervision circuit is sufficient. The supervision switches of the supervision circuit in this case lock into the open state after opening of the lock 12 and the supervision switches are arranged to remember their state also after an electricity outage situation.

In both the aforementioned solutions a run with the elevator is limited in such a way that only a service run can be driven with the elevator when the safety member 9*a* of the safety device 9 is turned in connection with opening of the lock 12 into its safe position. In this case a switch in the safety device 9 switches on a service drive circuit permitting a service run. The elevator car 3 can be driven in the up direction until the service drive limit. A safety switch at the service drive limit stops the elevator car before the elevator car collides with a mechanical safety device, such as a buffer.

After the servicing work the elevator is returned to normal drive by setting the safety devices to the normal drive position, inter alia in the manner presented above, and by removing the electrical supervision with a separate key switch. Electrical supervision is removed by electrically energizing the switches of the supervision circuit of the floor level doors 1*a*, 1*b* with the aforementioned key switch.

It is obvious to the person skilled in the art that the invention is not limited solely to the examples described above, but that it may be varied within the scope of the claims presented below. Thus, for example, the safety member and its operation can also be different to what is presented above. The safety member does not necessarily need to be turnably hinged, but instead it can e.g. be arranged to push also horizontally straight between the detent members.

It is further obvious to the person skilled in the art that the safety device and the frame part of it can be different to what is presented above. Instead of a rigid frame part, the frame part can be e.g. of two parts, which parts are configured to be movable in the vertical direction in relation to each other. In this case the first part of the frame part is arranged to be movable in the vertical direction, e.g. inside the enclosure-type second part, with some extent of freedom of movement. If the elevator car moves downwards and trips via the safety device the safety gear, or some other corresponding safety stopping device, the first part of the frame part of the safety device moves slightly downwards inside the enclosure-type second part. On the base of the enclosure-type second part is a spring, which is arranged to resist this movement and to return the safety device to its correct height when nothing presses it downwards any longer.

It is further obvious to the person skilled in the art that other types of safety stopping devices can be used in addition to the safety stopping devices, such as a safety gear and turnable stopping rods, presented above.

The invention claimed is:

1. An elevator, comprising:

an elevator car arranged to move reciprocally in an elevator hoistway, said elevator car being fitted on guide rails;

a plurality of landing doors, each having a landing door lock openable with a service key; and a safety arrangement, said safety arrangement being arranged to form a safe space in the elevator hoistway below the elevator car and/or above the elevator car, to which access is enabled via at least one of the plurality of landing doors, and in which elevator the safe space has a minimum height, wherein the safety arrangement comprises a mechanical transmission member and a safety device, wherein the mechanical transmission member extends from the door lock of the at least one landing door to the safety device, wherein the safety device is mechanically actuated via the mechanical transmission member, wherein the safety device is a spring-loaded tripping device rigidly fixed in the elevator hoistway and comprises:

a mounting base;

a locking detent mounted on the mounting base and configured to be moved along a single axis via a detent spring pressing against the locking detent;

a pin connected to the mounting base via a first hinge and connected to a transmission rod via a second hinge; and a stopper comprising a stopper spring;

wherein the transmission rod is connected to the stopper via a third hinge, wherein the mechanical transmission member is connected to the safety device at the locking detent at one end thereof, and wherein the stopper rests against a surface of the locking detent in a refracted position when the door lock is closed, wherein the stopper spring is configured to bias the stopper against the locking detent.

2. The elevator according to claim 1, wherein the mechanical transmission member is connected to the safety device in the bottom part of the elevator hoistway for forming a safe space below the elevator car by preventing undesired downward movement of the elevator car.

3. The elevator according to claim 1, wherein the mechanical transmission member is connected to the safety device in the top end of the elevator hoistway for forming a safe space above the elevator car by preventing undesirable upward movement of the elevator car.

4. The elevator according to claim 1, wherein the mechanical transmission member is a steel rope connected directly from the door lock to the safety device.

5. The elevator according to claim 1, wherein opening of the door lock pulls the locking detent away from the stopper, allowing the stopper to extend, thereby moving the pin, via the transmission rod, into a counterpart of the elevator car to lock the elevator car in a fixed position.

6. The elevator according to claim 1 wherein the safety device further comprises a return device configured to return the stopper to the retracted position.

7. The elevator according to claim 1, wherein the safety device comprises a switch that monitors the position of the safety member and informs a control system when the safety member is in a safe, locked position and when the safety member is in an inner position that permits normal drive with the elevator.

8. The elevator according to claim 1, wherein the elevator car comprises a counterpart with detent member(s), and wherein the counterpart is configured to receive a pin of the safety device for locking the elevator car into a fixed position.

9. An elevator, comprising:

an elevator car arranged to move reciprocally in an elevator hoistway, said elevator car being fitted on guide rails;

a plurality of landing doors, each having a landing door lock openable with a service key; and a safety arrangement, said safety arrangement being arranged to form a safe space in the elevator hoistway below the elevator car, access to the safe space being enabled via at least one of the plurality of landing doors, the safe space having a minimum height, wherein the safety arrangement further comprises a mechanical transmission member extending from the door lock of the at least one landing door to a safety device of the safety arrangement wherein the safety device is mechanically actuated via the mechanical transmission member, wherein the safety device is a spring-loaded tripping device rigidly fixed in the elevator hoistway and comprises:

a mounting base;

a locking detent mounted on the mounting base and configured to be moved along a single axis via a detent spring pressing against the locking detent;

a pin connected to the mounting base via a first hinge and connected to a transmission rod via a second hinge; and a stopper comprising a stopper spring;

wherein the transmission rod is connected to the stopper via a third hinge, wherein the mechanical transmission member is connected to the safety device at the locking detent at one end thereof, and wherein the stopper rests against a surface of the locking detent in a retracted position when the door lock is closed, wherein the stopper spring is configured to bias the stopper against the locking detent.

10. The elevator according to claim 9, wherein the formation of the safe space is arranged to be implemented as a consequence of the opening of the door lock of a floor level landing door, which enables access into the elevator hoistway.

11. The elevator according to claim 9, wherein opening of the lock activates the safety device via movement of the mechanical transmission member, thereby locking the elevator car into a fixed position.

12. The elevator according to claim 9, wherein the elevator car comprises a counterpart with detent member(s), and wherein the counterpart is configured to receive a pin of the safety device for locking the elevator car into a fixed position.

13. An elevator, comprising:

an elevator car arranged to move reciprocally in an elevator hoistway, said elevator car being fitted on guide rails;

a plurality of landing doors, each having a landing door lock openable with a service key; and a safety arrangement, said safety arrangement being arranged to form a safe space in the elevator hoistway above the elevator car, to which access is enabled via at least one of the plurality of landing doors leading to the roof of the elevator car, the safe space having a minimum height, wherein the safety arrangement further comprises a mechanical transmission member extending from the door lock of the at least one landing door to a safety device of the safety arrangement, wherein the safety device is mechanically actuated via the mechanical transmission member, wherein the safety device is a spring-loaded tripping device rigidly fixed in the elevator hoistway and comprises:

a mounting base;

a locking detent mounted on the mounting base and configured to be moved along a single axis via a detent spring pressing against the locking detent;

a pin connected to the mounting base via a first hinge and connected to a transmission rod via a second hinge; and a stopper comprising a stopper spring;

wherein the transmission rod is connected to the stopper via a third hinge, wherein the mechanical transmission member is connected to the safety device at the locking detent at one end thereof, and wherein the stopper rests against a surface of the locking detent in a retracted position when the door lock is closed, wherein the stopper spring is configured to bias the stopper against the locking detent.

14. The elevator according to claim 13, wherein opening of the lock activates the safety device via movement of the mechanical transmission member, thereby locking the elevator car into a fixed position.

15. A safety arrangement configured to form a safety space or safety spaces in an elevator at the base of an elevator hoistway and/or in the top part of the elevator hoistway, comprising:

a safety device; and a mechanical transmission member connected to the safety device at a first end and to a lock of an elevator car at a second end, wherein opening of the lock activates the safety device via movement of the mechanical transmission member, thereby locking the elevator car into a fixed position, wherein the safety device is a spring-loaded tripping device rigidly fixed in the elevator hoistway and comprises:

a mounting base;

a locking detent mounted on the mounting base and configured to be moved along a single axis via a detent spring pressing against the locking detent;

a pin connected to the mounting base via a first hinge and connected to a transmission rod via a second hinge; and a stopper comprising a stopper spring;

wherein the transmission rod is connected to the stopper via a third hinge, wherein the mechanical transmission member is connected to the safety device at the locking detent at one end thereof, and wherein the stopper rests against a surface of the locking detent in a retracted position when the door lock is closed, wherein the stopper spring is configured to bias the stopper against the locking detent.

* * * * *